United States Patent [19]

Pearrow et al.

[11] 4,361,091

[45] Nov. 30, 1982

[54] VACUUM POSITIONING SYSTEM FOR USE IN COMPOSING A PLATE FOR OFFSET PRINTING

[75] Inventors: Roy H. Pearrow; Jack Schoenberg, both of Little Rock, Ark.

[73] Assignee: Favorite Check Printers, Inc., Little Rock, Ark.

[21] Appl. No.: 768,220

[22] Filed: Feb. 14, 1977

[51] Int. Cl.[3] ..... B41F 27/04

[52] U.S. Cl. ..... 101/382 MV; 355/94

[58] Field of Search ..... 101/382 MV; 355/76, 355/79, 91, 94; 269/21

[56] References Cited

U.S. PATENT DOCUMENTS

| | | | |
|---|---|---|---|
| 2,672,080 | 3/1954 | Davidson | 355/94 |
| 3,264,106 | 8/1966 | Alldis | 355/79 |
| 3,499,377 | 3/1970 | Esses | 355/79 |
| 3,512,487 | 5/1970 | Kranz et al. | 355/91 |
| 3,771,870 | 11/1973 | Taylor | 355/94 |
| 3,913,118 | 10/1975 | Abrams | 355/79 |
| 3,945,879 | 3/1976 | Fletcher et al. | 269/21 |
| 3,949,295 | 4/1976 | Moorshead | 269/21 |
| 4,034,517 | 7/1977 | Weatherell et al. | 269/21 |

FOREIGN PATENT DOCUMENTS

| | | | |
|---|---|---|---|
| 1547639 | 10/1968 | France | 101/382 MV |

*Primary Examiner*—William Pieprz

*Attorney, Agent, or Firm*—Manfred M. Warren; Robert B. Chickering; Glen R. Grunewald

[57] ABSTRACT

A positioning system for quickly aligning and securing material to be composed for preparation of a plate for offset printing, such apparatus including a light source under a transparent support having alignment means on which background material, a template with nonlinear slots for aligning multilined overlay information, and overlay material for insertion into such nonlinear slots are positioned, all such material being held in place by vacuum.

6 Claims, 6 Drawing Figures

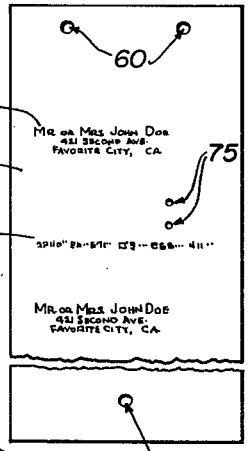
Fig. 5
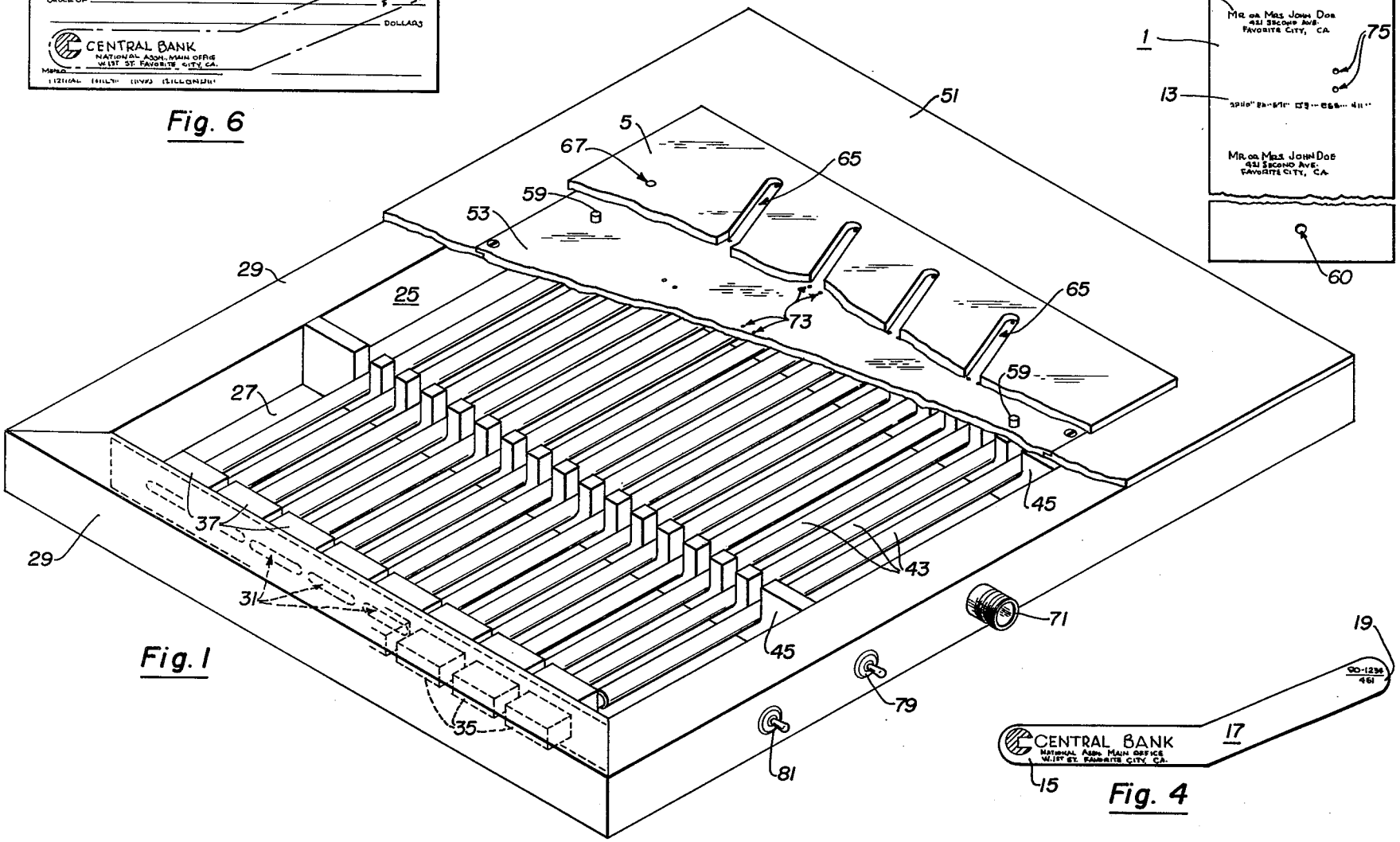
Fig. 4
Fig. 1
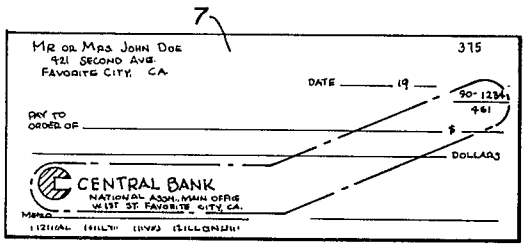
Fig. 6

VACUUM POSITIONING SYSTEM FOR USE IN COMPOSING A PLATE FOR OFFSET PRINTING

Our invention relates to means for preparing plates for an offset printing process and more particularly to the preparing of offset plates for the printing of personalized checks by this means.

The current method for printing personalized checks has not changed for many years. The customers name, address and bank information is set in hot metal type on a linotype machine, locked in a chase frame, placed in a printing press and printed. The number of checks printed at one time by this method is generally small and the number of time consuming copy changes is great.

Advances in offset presses, cold type and camera plate makers, has made it possible for personalized check printers to improve work quality and increase production. The type can now be set by way of photo composition and offset plates can be made in seconds without a negative or darkroom. The major problem now preventing printers from going with this offset method is the large number of copy changes that must be made because of the small check orders. The conventional method of composing copy for the camera requires hundreds of excess man hours, which, with this low quantity item, is economically unfeasible.

Among the objects of our invention are:

(1) To provide a new and improved apparatus for composing personalized printed material to appear on checks;

(2) To provide a new and improved apparatus for composing personalized printed material to appear on checks that includes a means for aligning copy;

(3) To provide a new and improved apparatus for composing personalized printed material to appear on checks that provide means for aligning additional overlay material;

(4) To provide a new and improved apparatus for composing personalized printed material to appear on checks that secures all copy material in surface to surface contact;

(5) To provide a new and improved apparatus for composing personalized printed material to appear on checks that provides its own light source in combination with means for aligning and securing all copy material.

Additional objects of our invention will be brought out in the following design of a preferred embodiment of the same taken in conjunction with the accompanying drawings, wherein:

FIG. 1 is a three dimensional view partially broken away, depicting the invention;

FIG. 4 depicts an element of the invention;

FIG. 5 is a view depicting another element of the invention;

FIG. 6 is a view depicting the relationship of FIG. 4 to a finished product of the invention.

Figure 2:
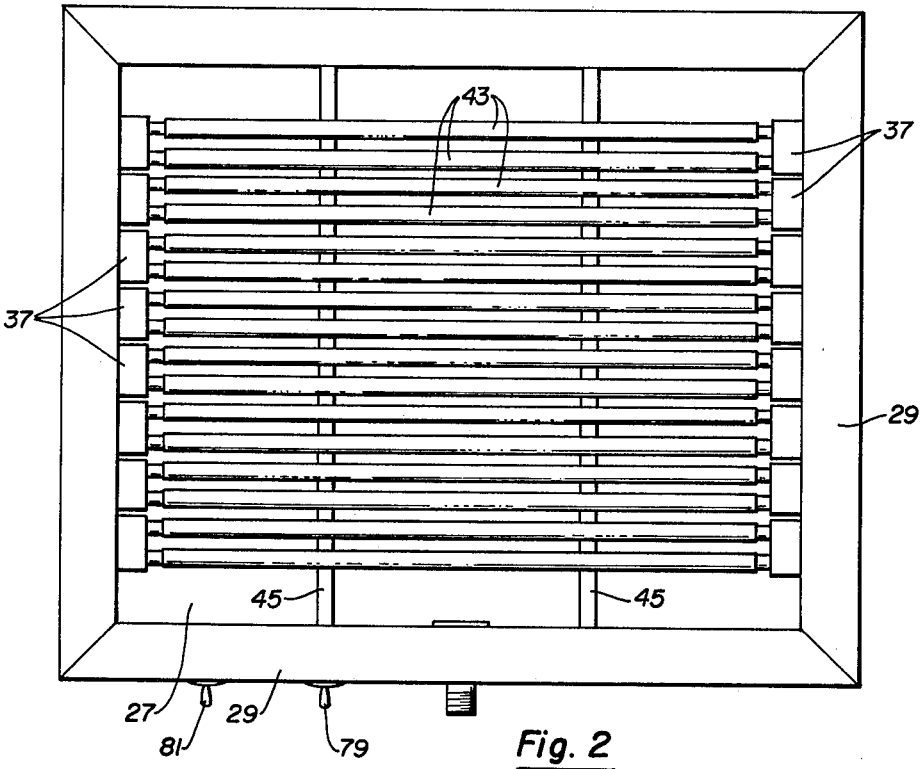
FIG. 2 is a plan view of the invention of FIG. 1 with the top removed.
Figure 3:
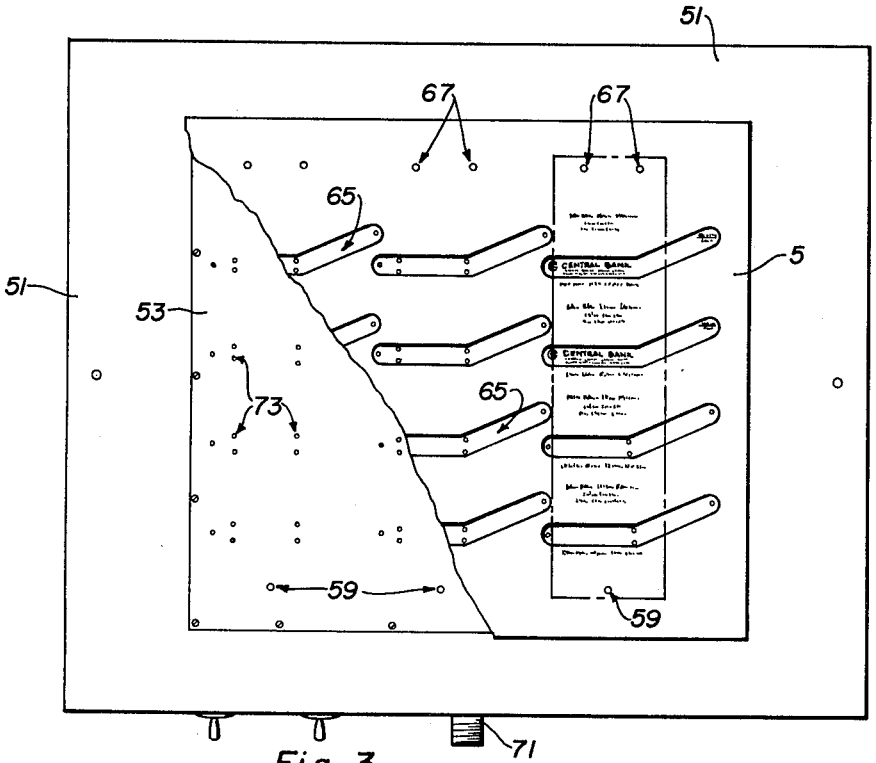
FIG. 3 is a plan view of the invention of FIG. 1, partially broken away depicting manner of use.

For details of our invention in its preferred form, reference will be had to the accompanying drawings wherein the system comprises a source of light for illuminating a transparent means supporting sheets of background information material 1 to be used in the creation of a plate for applying personalized information to bank checks by an offset printing process. Such supporting surface contains means for accurately positioning and securing such background material along with means for positioning a template 5 for accurately locating on such background material additional overlay information as may be desirable to appear with same.

As in the case of bank checks 7 for example, background material would contain such personal information as name and address 9 above the micro-encoded number 13 for a particular checking account. This information may be output from a phototype setter, printed photographically on sensitized paper from information coded on punched paper tape or similar device.

Additional information material, such as the bank name and logo 15 which does not lend itself to the same ready creation process as personalized data, may be previously prepared and stored on a separate strip 17 along with the bank transit routing number 19 and can be accurately located and secured in pressure engagement with the background material on the supporting surface during the making of the plate.

The light source is contained in a rectangular housing 25 having a bottom with hollow side walls 29, two opposing walls of which contain a plurality of small openings 31 in their inner surface. Fluorescent lamp transformers 35 are mounted behind these openings inside the hollow walls and terminal strips 37 are mounted on the opposite side of the openings fronting toward the center of the housing for the connection of fluorescent lamps 43 to the transformers.

Mounted parallel to the side walls with the terminal strips and spanning the inside of the housing between the opposite walls, are a pair of lamp supports 45 with a plurality of aligned notches spaced apart from the walls and each other. Fluorescent lamps 43 are maintained in such notches to be connected with the transformers via the terminal strips toward either end thereof.

A flat aluminum frame 51 of substantially the same dimensions as the outer perimeter of the housing 25 has an inserted transparent supporting surface 53 of substantially the size of the opening defined by the frame.

In the preferred embodiment, the personalized background information sheets 1 are in the form of narrow strips. To facilitate alignment of these strips, three pairs of dowel pins 59 along one edge of the supporting surface and three singles along the other, match aligned holes 60 in the background information strips, which are laid flat thereon for alignment purposes.

Additional information material 15, 19 to be overlaid upon the background sheet, may be stored on a strip 17 shaped to present the information at any desired position with respect to such background. In the current case of a check, the information material 15 which is the bank logo and the information material 19, which is the transit number, appear on separate lines of the check and the strip is angled such that one strip may carry both pieces of data and present them at their correct relative positions.

The transparent template 5, preferably of plexiglass or like material, contains accurately positioned openings 65 conforming to the shape of the strip 17 containing the overlay material, along with openings 67 to match the dowel pins 59 on the supporting surface that align the background information strips 1. When the templates is laid on the supporting surface over the background material, the additional overlay information material may be dropped very quickly into the openings 65 to be accurately positioned thereon.

To facilitate securing the additional overlay material in surface to surface contact with the background material, an inlet fitting through one of the hollow walls 29 is threaded to connect to a vacuum source of any conventional type. This will create a vacuum in the region below the plexiglass supporting surface. By providing holes 73 and 75 through the supporting surface and background sheets respectively, in alignment with the positioning openings 65, the overlay material will be exposed to a differential pressure holding them in pressure contact with the background material to complete the composition layout for an offset plate.

To use the vacuum positioning system, one need only to lay the background strips 1 on the supporting surface 53 over the alignment dowels 59 followed by the template 5 on the same dowels 59 and drop the overlay material 17 into the positioning openings therein. A first switch 79 may be used to control power to the light source and a second switch 81 to control power for the vacuum source that holds the elements to be photographed in surface to surface contact. It can be seen how the ease of alignment of the background material on the supporting surface and the ease of applying additional information material facilitates rapid changing of the layout for the next plate to be created.

From the foregoing description of our invention in its preferred form, it will become apparent that the same is thus subject to alteration and modification without departing from the underlying principles involved, and we do not desire to be limited in our protection to the specific details illustrated and described except as may be necessitated by the appended claims.

I claim:

1. Apparatus for use in quickly and repetitively preparing a plate requiring critical accuracy for offset printing comprising a source of light, means for supporting background information sheet material in a path of illumination by said light source, means for accurately and quickly positioning said background sheet material on said supporting means, said positioning means including alignment pins as part of said supporting means to match aligned holes in said background information sheet material, means for accurately and quickly locating on such background information sheet material additional overlay information material to appear on such printing plate said locating means comprising a transparent template with accurately positioned openings for locating and positioning overlay informational material, said template having alignment holes to match said alignment pins, and means for holding said background information sheet material and such additional overlay information material in pressure engagement with said supporting means.

2. Apparatus in accordance with claim 1, characterized by said positioning openings being continuous nonlinear slots, whereby overlay informational material may be imposed on said background sheet on more than one line with use of only one slot.

3. Apparatus for use in quickly and repetitively preparing a plate requiring critical accuracy for offset printing comprising a source of light, means for supporting background information sheet material in a path of illumination by said light source, means for accurately and quickly positioning said background sheet material on said supporting means, means for accurately and quickly locating on such background information sheet material additional overlay information material to appear on such printing plate and means for holding said background information sheet material and such additional overlay information material in pressure engagement with said supporting means, said holding means comprising a bottom, sides, and top surface; said background information sheet supported on said top or supporting surface, a vacuum source for said housing, a plurality of openings on said supporting surface under the area of said background information material and corresponding openings in said background information material sheet in alignment with the location of said additional information material, whereby after positioning of said material on said supporting surface application of vacuum thereto will hold such informational materials in pressure engagement thereon.

4. An apparatus in accordance with claim 3, characterized by said housing containing said light source within, in alignment with said information materials.

5. An apparatus for quickly and repetitively preparing a plate requiring critical accuracy for offset printing, comprising a source of light, supporting means for background informational material and overlay information material, means including a transparent template having accurately positioned openings aligned over said background information material for accurately and quickly positioning said overlay information material, vacuum means for exposing the region below said supporting means to reduced pressure, a plurality of openings through said supporting means for exposing said background material to said reduced pressure, and selected openings through said background material coinciding with openings through said supporting means in alignment with the position of said overlay information material, whereby, said aligned overlay information material is exposed to such vacuum through said openings in said background information material to be held in position thereon.

6. An apparatus in accordance with claim 5 characterized by alignment pins as part of said supporting means to match aligned openings in said background information material and said transparent template, whereby, said alignment pins align both said background material and said template upon said supporting means.

* * * * *